US007028991B2

(12) United States Patent
Egan

(10) Patent No.: US 7,028,991 B2
(45) Date of Patent: Apr. 18, 2006

(54) LOCKABLE PROTECTIVE CAP FOR POSTS

(76) Inventor: Robert J. Egan, 7770 W. Stene Dr., Littleton, CO (US) 80128

( * ) Notice: Subject to any disclaimer, the term of this patent is extended or adjusted under 35 U.S.C. 154(b) by 0 days.

(21) Appl. No.: 10/810,240

(22) Filed: Mar. 25, 2004

(65) Prior Publication Data

US 2005/0211968 A1 Sep. 29, 2005

(51) Int. Cl.
*E04H 17/14* (2006.01)

(52) U.S. Cl. ..... 256/1; 256/65.01

(58) Field of Classification Search ..... 256/1, 256/65.01
See application file for complete search history.

(56) References Cited

U.S. PATENT DOCUMENTS 4,964,619 A * 10/1990 Glidden, Jr. ..... 256/32
5,701,998 A * 12/1997 Perry et al. ..... 206/315.1
6,543,750 B1 * 4/2003 Calzone ..... 256/1
6,612,551 B1 * 9/2003 Roy ..... 256/1
6,619,628 B1 * 9/2003 Steffes ..... 256/1
2003/0127638 A1 * 7/2003 Young ..... 256/59
2003/0160226 A1 * 8/2003 Steffes ..... 256/65.01
2004/0108342 A1 * 6/2004 Gomez et al. ..... 222/521

* cited by examiner

*Primary Examiner*—John R. Cottingham
(74) *Attorney, Agent, or Firm*—Hensley Kim & Edgington, LLC

(57) ABSTRACT

A lockable protective cap for a post is disclosed. The protective cap comprises a sidewall having a first end and an open second end. The sidewall forms a post receiving opening for receiving a post through the open second end. The cap further comprises a cover at least partially closing the first end of the sidewall and a locking member extending from the sidewall for engaging an engageable surface of the post.

19 Claims, 3 Drawing Sheets

LOCKABLE PROTECTIVE CAP FOR POSTS

FIELD OF THE INVENTION

The present invention relates to a lockable protective cap that may be secured to a post to prevent people or animals from being injured on the post.

BACKGROUND OF THE INVENTION

Metal posts having a "T" cross-section are often used as fence posts or supports for plants, such as newly planted trees. These posts are often manufactured by extrusion or rolling and then sheared to length. The shearing process typically leaves a sharp edge or burr on the top of the post. Additionally, as the post is driven into the ground, the top of the post is flattened and creates a sharp edge around the perimeter of the post. Injuries to people or livestock from the sharp edges on a post range from small scratches or cuts to deep lacerations or impalement.

Where metal posts have been installed in public areas, such as around schools and playgrounds, children have been injured by exposed sharp edges on the tops of the posts. Even where protective caps have been placed on the posts, children or teenagers often remove the caps from the posts leaving the sharp edges exposed.

SUMMARY OF THE INVENTION

The present invention comprises a lockable, protective cover or cap for the top of posts. The cap comprises a sidewall having a first end and a second open end, the sidewall forming a post receiving opening; a cover at least partially closing the first end of the sidewall; and a locking member extending inwardly from the sidewall for engaging the engageable surface of the post.

DETAILED DESCRIPTION

Figure 1:
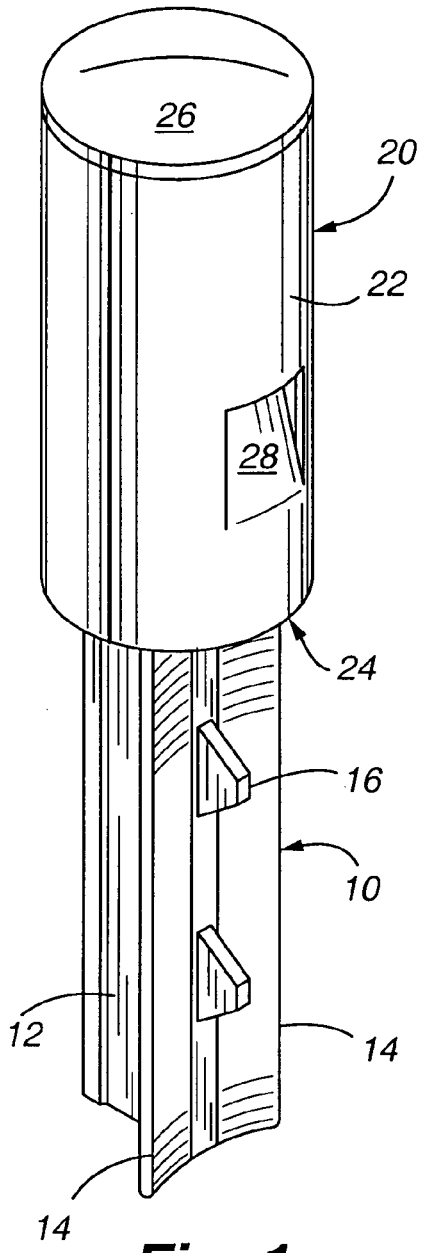
FIG. 1 shows a perspective view of a first embodiment of a lockable protective cap of the present invention installed on a post.
Figure 2:
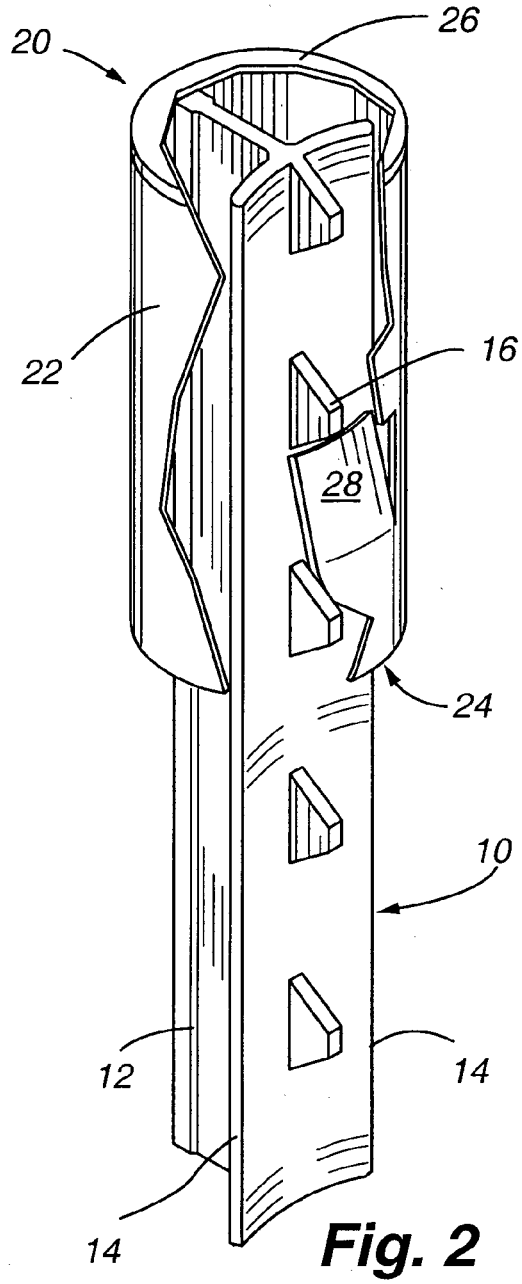
FIG. 2 shows a broken perspective view of the embodiment of a lockable protective cap of FIG. 1 installed on a post.

FIGS. 1 and 2 show a typical "T-shaped" metal post 10. The post 10 comprises an elongated shaft 12 having laterally extending flanges 14. A series of protruding studs 16 extend along a front surface of the post 10. The precise location of the studs 16 along any particular post is somewhat random depending on where the post has been cut. Therefore, a first stud may be positioned directly at the top edge of the post 10, it may be spaced apart from the top edge, or only a partial stud may be present at the top of the post, all depending upon where the post is cut during the manufacturing process. Although the present invention is generally described with respect to such a "T-shaped" post, one skilled in the art would readily understand that the invention may also be used with respect to posts of other shapes as long as the posts comprise a structure that may be engaged, such as the studs 16 of the "T-shaped" posts described herein.

Figure 3:
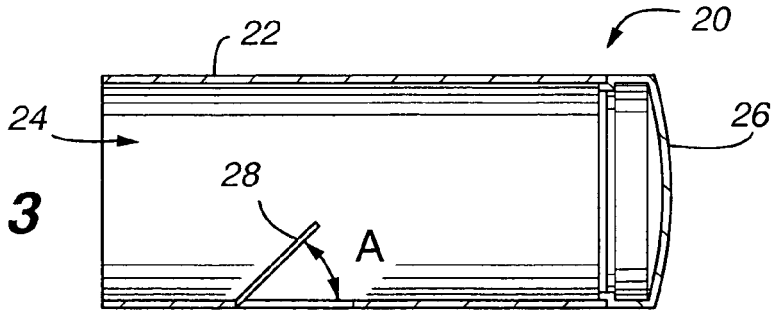
FIG. 3 shows a cross-sectional view of the embodiment of a lockable protective cap of FIG. 1.
Figure 4:
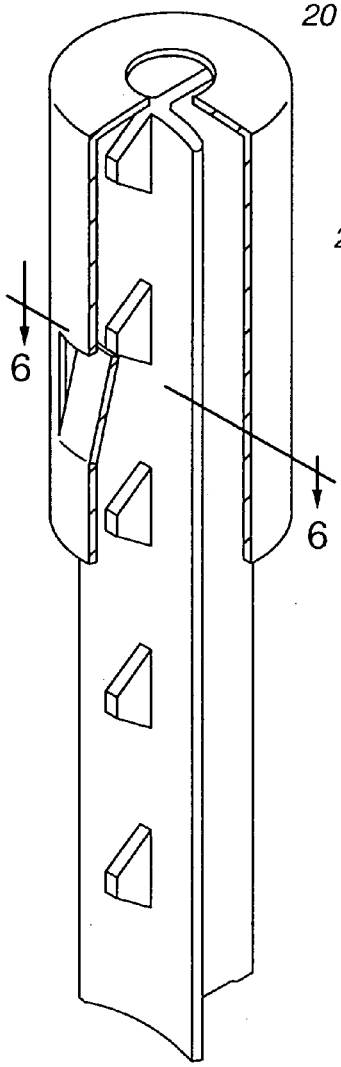
FIG. 4 shows a partially-sectional perspective view of a second embodiment of a lockable protective cap of the present invention.
Figure 5:
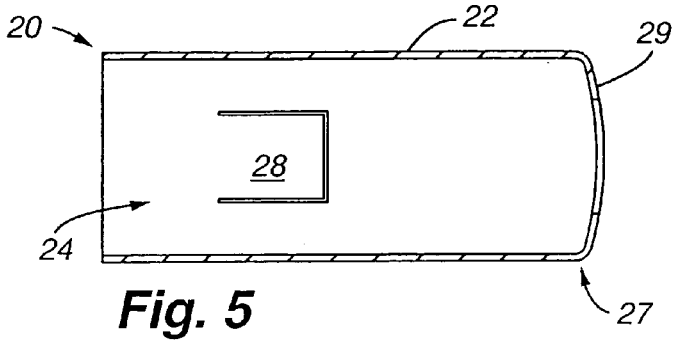
FIG. 5 shows a cross-sectional view of the embodiment of a lockable protective cap of FIG. 4.
Figure 6:
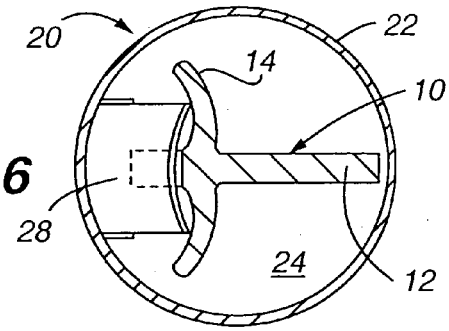
FIG. 6 shows a cross-sectional view of the embodiment of a lockable protective cap of FIG. 4 installed on a post taken along section line 6—6.

FIGS. 1 through 3 show a first embodiment of a lockable protective post cap 20 of the present invention that may be used with a post, such as the "T-shaped" post shown in FIGS. 1 and 2. The cap 20 comprises a sidewall 22 forming a post-receiving opening 24 and a cover 26. The cover 26 may be integrally formed with the sidewall 22 (see, e.g., FIGS. 4, 5, 10 and 12) or may be separately formed and attached to the sidewall 22 (see, e.g, FIGS. 1 through 3), such as via adhesion, fusion, heat staking or the like. Where the cover 26 and the sidewall 22 are separately formed and attached, such as shown in FIGS. 1 through 3, the cover 26 and sidewall 22 may be formed such that the outer wall of the cover and the outer wall of the sidewall fit flush with each other or either the cover 26 or the sidewall 22 may overlap one another. The cover 26 is preferably rounded, as shown in FIGS. 4 and 5, so that the cap 20 does not provide any exposed sharp edges.

The cap 20 further comprises a locking member 28 for engaging a stud 16 of the post 10. In this embodiment, the locking member 28 protrudes inwardly at an angle A from the sidewall 22 of the cap 20. In one embodiment, for example, the angle A may comprise an angle from about 30 degrees to about 60 degrees, from about 40 degrees to about 50 degrees or about 45 degrees. The locking member 28 may be formed unitarily with the sidewall 22 as shown in FIGS. 1 through 3 or may comprise a separate portion that is attached to the sidewall 22 of the cap 20. The locking member 28 may be formed unitarily with the sidewall 22, for example, such as via molding or extruding, or may be formed of a separate portion attached to the body, such as via adhering, fusing, heat staking or the like. In one embodiment of the present invention, for example, the locking member 28 may be punched or cut out of the sidewall 22 and bent to form the locking member 28. Alternatively, the locking member 28 may be molded or otherwise formed at an angle from the sidewall 22.

The locking member 28 provides an angled surface 30 for sliding over an engaging surface of the post 10, such as a stud 16, as the cap 20 slides over the end of the post 10. In this embodiment, the locking member 28 may be flexible enough to deform over a stud 16 as the cap 20 slides over the end of the post 10. As the locking member 28 slides past the stud 16, however, the locking member 28 is sufficiently resilient to engage the stud 16 of the post 10. Thus, the locking member 28, after passing the stud 16, rebounds and the distal end 32 of the locking member 28 provides a surface for engaging the stud 16 and prevents the cap 20 from being removed from the post 10. In another embodiment, the sidewall 22 of the cap 20 may deform along with or instead of the locking member 28 as the cap 20 slides over the end of the post 10 and the angled surface 30 comes into contact with the stud 16. In this embodiment, after the locking member 28 passes the stud 16, the sidewall 22 and/or the locking member 28 of the cap 20 rebound and the distal end 32 of the locking member 28 provides a surface for engaging the stud 16 and prevents the cap from being removed from the post 10.

The sidewall 22 may comprise a generally cylindrical shape as shown in FIGS. 1 through 12 or may comprise any other shape for receiving a post 10. For a T-shaped post 10, such as shown in FIGS. 1 and 2, for example, the sidewall 22 may comprise a generally T-shaped configuration for receiving the post within the post-receiving opening 24. In this embodiment, for example, the generally T-shaped configuration of the sidewall 22 prevents the cap 20 from being twisted with respect to the post 10. This, in turn, prevents the locking member 28 from being disengaged from the stud 16 of the post 10 by turning the cap 20 with respect to the post 10. In another embodiment, after the cap 20 is placed onto the end of the post 10, the sidewall 22 may be deformed around at least a portion of the post 10 to prevent the cap 20 from being twisted with respect to the post 10 and, in turn, prevent the locking member 28 from being disengaged from the stud 16 of the post 10 by turning the cap 20 with respect to the post 10.

Since the position of the studs 16 with respect to a post may vary with respect to the top of the post 10, the distance between the inner surface of the cap 20 and the distal end 32 of the locking member 28 preferably is long enough to ensure that at least one stud is located above the distal end 32 of the locking member 28 when the cap 20 is placed over the top of the post 10. Thus, the distance between the inner surface of the cap 20 and the distal end 32 of the locking member 28 is preferably at least equal to the center-to-center spacing of the studs on a post 10. Where a post 10 includes two inch center-to-center spacing between studs, for example, the cap 20 preferably comprises a length from the inner surface of the cover 26 to the distal end 32 of the locking member 28 of at least two inches. Even more preferably, since a stud or a partial stud may be located at the very top of the post 10 and may be damaged when the post is driven into the ground, the cap 20 comprises a length from the inner surface of the cover 26 to the distal end 32 of the locking member 28 of at least the center-to-center spacing of the studs 16 plus the length of a stud 16 so that the locking member 28 of the cap 20 may engage a stud displaced from the top edge of the post 10. In the example above where the center-to-center spacing of the studs is two inches and where the length of a stud is about 0.75 inches, for example, the length of cap from the inner surface of the cover 26 where the top edge of a post could abut the cover to the distal end 32 of the locking member is preferably at least about 2.75 inches.

As shown in FIGS. 4 and 5, the cap 20 may comprise a cover 27 that does not completely enclose the top end of the cap 20. In this embodiment, the cover 27 comprises a protective lip 29 that extends around the cap and covers at least the periphery of the post 10. The protective lip 29 prevents the cap from sliding down the post and exposing the top end of the post. While potentially sharp edges of the post 10 may be accessed through the opening in the cover 27, the protective lip 29 reduces the likelihood of accidental contact with those edges.

Figure 7:
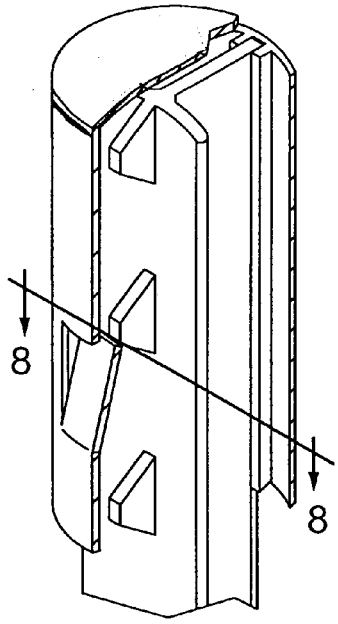
FIG. 7 shows a partially-sectional perspective view of a third embodiment of a lockable protective cap of the present invention.
Figure 8:
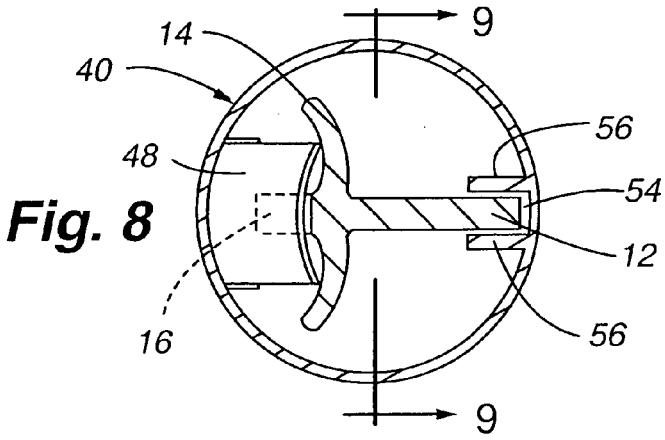
FIG. 8 shows a cross-sectional view of the embodiment of a lockable protective cap of FIG. 7 installed on a post taken along section line 8—8.
Figure 9:
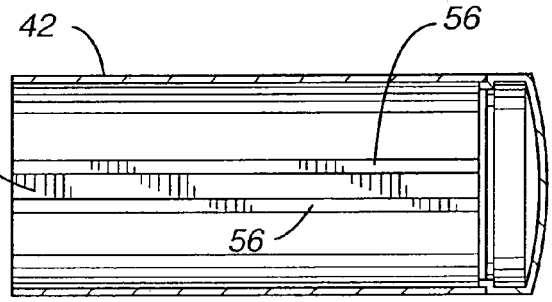
FIG. 9 shows a cross-sectional view of the embodiment of a lockable protective cap of FIGS. 7 and 8 taken along section line 9—9.

FIGS. 7 through 9 show another embodiment of a cap 40 of the present invention. The cap 40 further comprises channel 54 for receiving an elongated shaft 12 or flange 14 of the post 10. The channel 54 may, for example, extend the length of the sidewall 42 as shown in FIG. 9 or may extend only a portion of the length of the sidewall 42. The channel 54 may be formed unitarily with the sidewall 42 of the cap 40, such as via molding or extruding, or may comprise one or more separately formed portion that is attached to the sidewall 42 of the cap 40, such as via adhering, fusing, heat staking or the like, or may comprise an opening in the sidewall (e.g., a slot) through which the elongated shaft 12 or a flange 14 of a post may be extended. In the embodiment shown in FIGS. 7 through 9, for example, the elongated shaft 12 or flange 14 of the post extends into the channel 54 and the channel walls 56 prevent the cap 40 from being twisted with respect to the post 10. Thus, the locking member 48 remains aligned with the stud 16 of the post 10 and prevents the locking member 48 from being disengaged from the stud 16 of the post 10 by turning the cap 40 with respect to the post 10.

Figure 10:
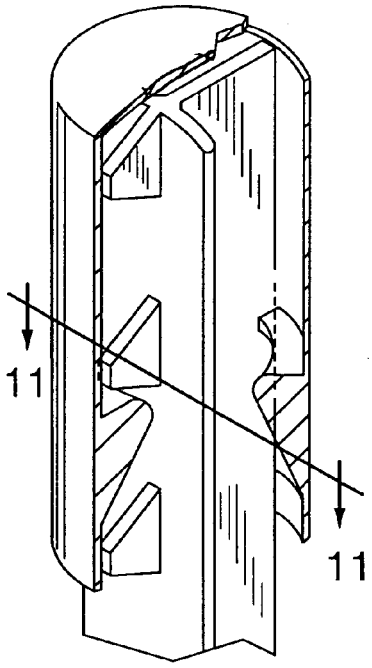
FIG. 10 shows a partially-sectional perspective view of a third embodiment of a lockable protective cap of the present invention.
Figure 11:
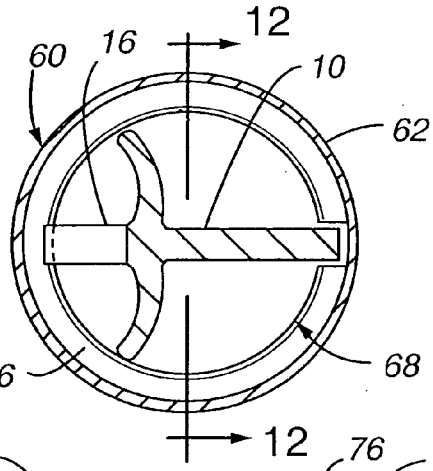
FIG. 11 shows a cross-sectional view of the embodiment of a lockable protective cap of FIG. 10 installed on a post taken along section line 11—11.
Figure 12:
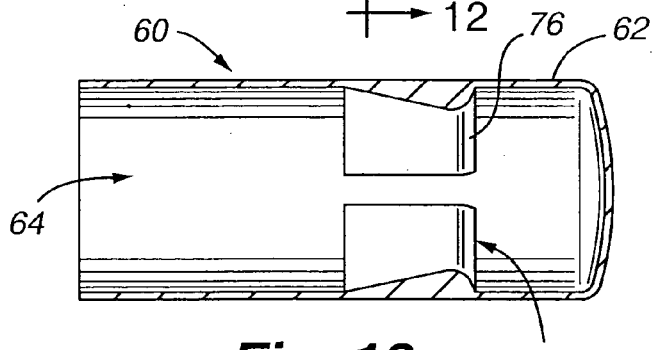
FIG. 12 shows a cross-sectional view of the embodiment of a lockable protective cap of FIGS. 10 and 11.

FIGS. 10 through 12 show yet another embodiment of a cap 60 of the present invention. The cap 60 comprises a locking member 68 extending from the interior of the sidewall 62 of the cap 60. In this embodiment, the locking member 68 may be unitarily formed with the sidewall or may comprise a member separately formed and attached to the sidewall 62. The locking member 68 may further comprise a rib 76 that extends around an arc of the sidewall 62. The rib 76 may extend around the entire perimeter, or substantially around the entire perimeter, of the post-receiving opening 64, or may extend around only a portion of the perimeter of the post-receiving opening 64. In an embodiment in which the locking member 68 comprises a rib 76 extending around the entire or a substantial portion of the perimeter of the post-receiving opening 64, the rib 76 may be used to engage a post where the studs extend further from the shaft than the flanges of the post or where a particular post does not include flanges. In this embodiment, the rib 76 provides a locking member 68 that is more easily aligned with a stud 16 of the post and allows the cap 60 to be turned substantially completely around the post without disengaging the locking member 68 of the cap 60 from the stud 16 of the post 10.

A cap of the present invention may be manufactured at least partially comprising a sufficiently resilient material to allow the locking member to engage a portion of a post. Preferably, the cap is manufactured using a low-cost resilient plastic such as poly vinyl chloride (PVC), acrylonitrile-butadienestyrene (ABS), or a styrene-acrylonitrile copolymer (SAN). Alternatively, other resilient materials may be used.

While the invention has been particularly shown and described with reference to a preferred embodiment thereof, it will be understood by those skilled in the art that various other changes in the form and details may be made without departing from the spirit and scope of the invention.

I claim:

1. A lockable protective cap for a post having a top end and an engageable surface, the cap comprising:

a sidewall having a first end and an open second end, said sidewall forming a post-receiving opening;

a cover at least partially closing said first end of said sidewall; and a locking member extending inwardly from said sidewall for engaging the engageable surface of the post, said locking member comprising a first end disposed at said sidewall, a second end disposed opposite said first end, a ramp surface disposed between said first end and said second end, and an engaging surface disposed at said second end for locking the engageable surface of the post within said post-receiving opening, said locking member being resiliently hinged at said sidewall.

2. The cap of claim 1, wherein said cover completely encloses said first end of said sidewall.

3. The cap of claim 1, wherein said cover provides a protective lip at said first end of said sidewall for covering at least a portion of the top end of the post.

4. The cap of claim 1 ,wherein said ramp surface of said looking member extends inwardly from said sidewall at an angle from about 40 degrees to about 50 degrees.

5. The cap of claim 1, wherein said locking member is formed by a portion of said sidewall extending inwardly into said post-receiving opening.

6. The cap of claim 1, wherein said locking member comprises a rib.

7. The cap of claim 6, wherein said rib extends substantially around the perimeter of said post-receiving opening of said sidewall.

8. The cap of claim 1, wherein said sidewall further comprises a channel for mateably engaging a portion of the post.

9. The cap of claim 1, wherein said locking member is formed unitarily with said sidewall.

10. The cap of claim 1, wherein at least one of said locking member and said sidewall are deformable to slide over the engageable surface of the post.

11. The cap of claim 1, wherein said locking member comprises a tab.

12. The cap of claim 1, wherein said engaging surface of said locking member is displaced from said sidewall for engaging the engageable surface of the post.

13. The cap of claim 1, wherein a distance between an inner surface of said cover and an engaging surface of said locking member comprises a distance of at least about a center-to-center spacing between engageable surfaces of the post.

14. The cap of claim 1, wherein a distance between an inner surface of said cover and an engaging surface of said locking member comprises a distance of at least about two inches.

15. The cap of claim 1, wherein a distance between an inner surface of said cover and an engaging surface of said locking member comprises a distance of at least about a center-to-center spacing between engageable surfaces of the post plus about the length of the engageable surface of the post.

16. The cap of claim 1, wherein a distance between an inner surface of said cover and an engaging surface of said locking member comprises a distance of at least about 2.75 inches.

17. A lockable protective cap for a post having a top end and an engageable surface, the cap comprising:

a sidewall having a first end and an open second end, said sidewall forming a post receiving opening; p1 a cover at least partially closing said first end of said sidewall;

a locking member extending inwardly from said sidewall for engaging the engageable surface of the post; and a means for preventing said cap from rotating about the post.

18. The cap of claim 17, wherein said means for preventing said cap from rotating about the post comprises at least one of a channel, a slot, an opening in said sidewall, and a deformable sidewall.

19. The cap of claim 17, wherein said means for preventing said cap from rotating about the post comprises said sidewall being formed to match the shape of at least a portion of the post.

* * * * *